US005575621A

United States Patent [19]

Luketićet al.

[11] Patent Number: 5,575,621

[45] Date of Patent: Nov. 19, 1996

[54] COMPRESSOR WITH A GUIDE VANE FASTENING ARRANGEMENT

[75] Inventors: Ivan Luketić, Siggenthal Station; Alfred Krähenbühl, Gipf-Oberfrick, both of Switzerland

[73] Assignee: ABB Management AG, Baden, Switzerland

[21] Appl. No.: 507,216

[22] Filed: Jul. 26, 1995

[30] Foreign Application Priority Data

Oct. 14, 1994 [DE] Germany ..... 44 36 731.7

[51] Int. Cl.[6] ..... F01D 9/04; F01D 5/30; F04D 29/60

[52] U.S. Cl. ..... 415/209.2; 415/209.3; 416/215

[58] Field of Search ..... 415/209.2, 209.3; 416/215

[56] References Cited

U.S. PATENT DOCUMENTS

| | | | |
|---|---|---|---|
| 2,247,387 | 7/1941 | Johnson et al. | 415/209.2 |
| 2,247,423 | 7/1941 | Webster, Jr. | 415/209.2 |
| 3,817,655 | 6/1974 | Huesgen et al. | 415/209.2 X |
| 5,308,227 | 5/1994 | Gros et al. | 416/198 A |
| 5,387,082 | 2/1995 | Matyscak | 415/209.3 |

FOREIGN PATENT DOCUMENTS

| | | | |
|---|---|---|---|
| 2165529 | 7/1973 | Germany . | |
| 26455 | 12/1903 | United Kingdom | 415/209.2 |

*Primary Examiner*—Edward K. Look
*Assistant Examiner*—Michael S. Lee
*Attorney, Agent, or Firm*—Oblon, Spivak, McClelland, Maier & Neustadt, P.C.

[57] ABSTRACT

A compressor having an axially divided casing, includes a plurality of casing halves. Guide vanes are fastened by their roots in peripheral grooves. Distributed over the periphery, bolts are introduced, which are anchored in the groove base of the peripheral groove. These bolts preferably project radially into the peripheral groove and divide the guide vanes into aggregates and end aggregates situated at the partition plane of the casing.

6 Claims, 2 Drawing Sheets

COMPRESSOR WITH A GUIDE VANE FASTENING ARRANGEMENT

BACKGROUND OF THE INVENTION

1. Field of the Invention

The invention relates to a compressor having an axially divided casing, comprising a plurality of casing halves, in which the guide vanes are fastened by their roots in peripheral grooves.

2. Discussion of Background

Compressors of this type are known. Usually there are intermediate pieces arranged between the guide vane roots. During running of the compressor, the air is heated by the compression. The compressed air delivers heat to the intermediate pieces and the vane material, which causes these to expand. In order to prevent the stresses resulting from the heat expansion in the vane root region, which stresses can lead to material defects, the guide vanes and the intermediate pieces are inserted in the casing with play. When the vanes are installed in the casing, paper interlays are placed between the vane roots in order to distribute the play evenly onto the periphery.. Some intermediate pieces are fixed by means of underlays inserted beneath the intermediate pieces. During running of the compressor, the paper interlays burn. If the gas turbine aggregate is switched off and re-started, the fixing of the intermediate pieces can be loosened by vibrations. The guide vanes can consequently slide together in the cooled state.

The vanes are respectively installed in the axially divided casing at the site of erection of the compressor. Conditioned by the inaccuracy ensuing from the summation of the production tolerances of the individual elements and as a result of the play distribution with paper interlays, the elements which are situated at the partition plane of the casing can only be precisely machined at the site of erection. To this end, the guide vanes are installed in the casing with paper interlays, the protruding, close-off elements situated at the partition plane are milled over, and holes for fastening the close-off elements are drilled. In order to remove chips and dirt, all elements have to be removed again. Following cleaning, the elements are reinstalled in just the same way as in the first installation step. This means a high labor expenditure and, therefore, high costs.

SUMMARY OF THE INVENTION

Accordingly, one object of the invention, in a compressor of the type stated in the introduction, is to facilitate the installation of the guide vanes in the compressor casing.

According to the invention, this is achieved by the fact that bolts are introduced which are anchored in a groove base of the peripheral groove, of the casing. The bolts are distributed over the periphery of the casing and preferably project radially into the peripheral groove and divide the guide vanes into aggregates and end aggregates situated at the partition plane of the casing.

The advantages of the invention can be seen, inter alia, in the fact that the position of the bolts is accurately known, and that the individual sums of the production tolerances of the aggregates can be sufficiently accurately determined. In addition, the bolts distribute the play evenly over the periphery of the casing. The play of the individual aggregates is easily adjustable. When the aggregates are installed in the casing, further finishing work is no longer necessary, thus considerably reducing the labor or expenditure of work involved.

It is particularly expedient if the end aggregate situated at the partition plane of the casing is already prefabricated at the factory and is machined to the necessary dimensions.

BRIEF DESCRIPTION OF THE DRAWINGS

A more complete appreciation of the invention and many of the attendant advantages thereof will be readily obtained as the same becomes better understood by reference to the following detailed description of a compressor with axial throughflow when considered in connection with the accompanying drawings, wherein.

Only those elements which are fundamental to an understanding of the invention are shown, for example, the rotor with the guide vanes is not represented.

DESCRIPTION OF THE PREFERRED EMBODIMENTS

Figure 1:
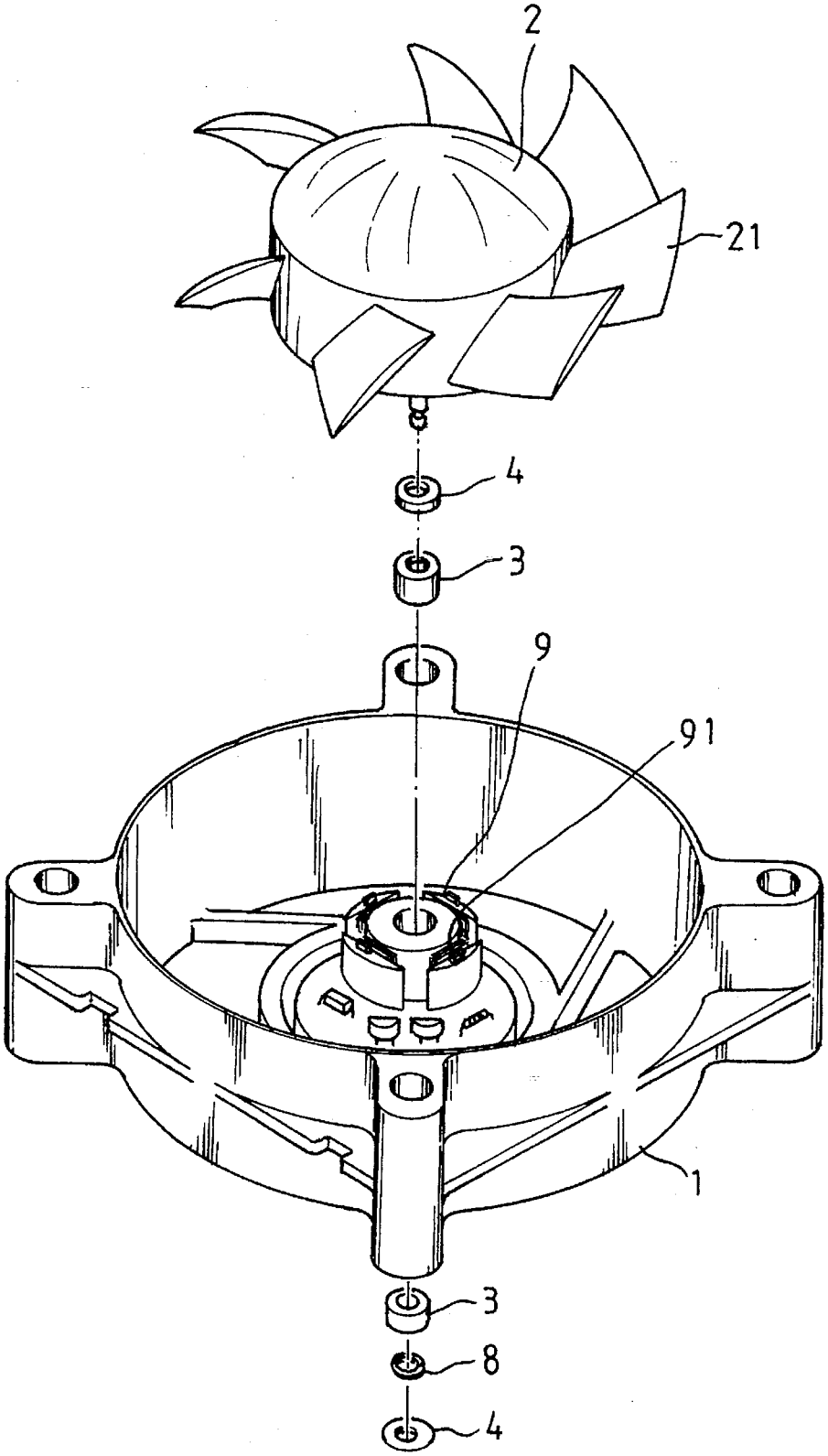
FIG. 1 shows a diagrammatic cross section through a compressor casing.
Figure 2:
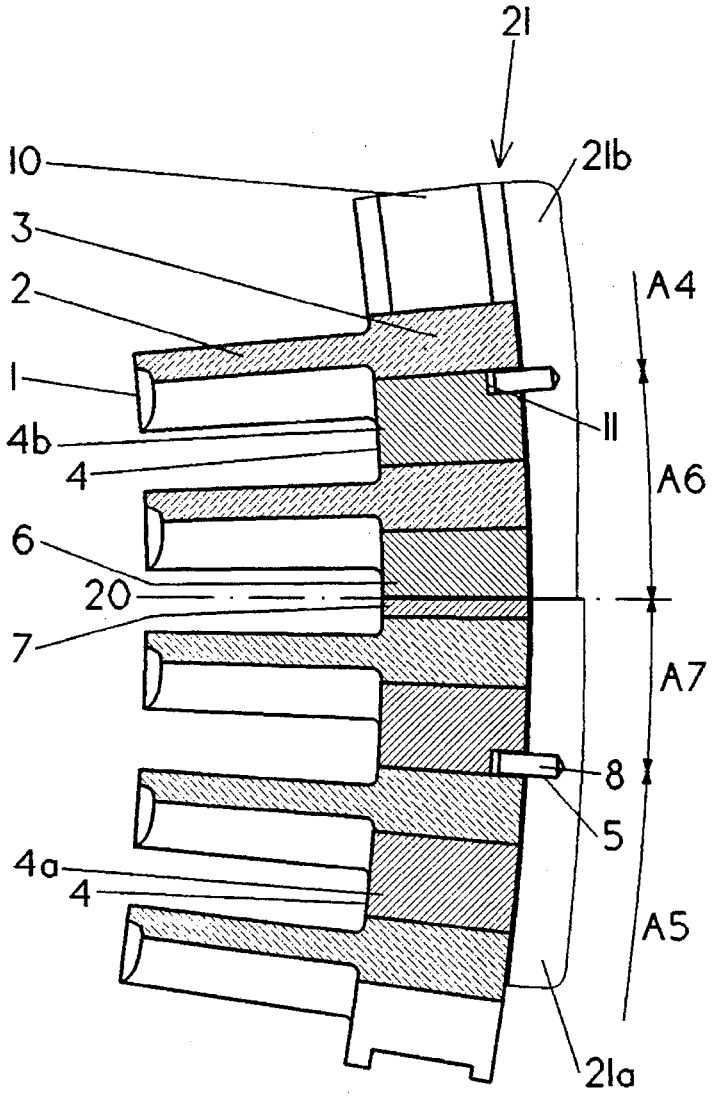
FIG. 2 shows the enlarged detail II from FIG. 1.

Referring now to the drawings, wherein like reference numerals designate identical or corresponding parts throughout the several views, in FIG. 1 the compressor casing 21 comprises a lower casing half 21*a* and an upper casing half 21*b*, having an axial partition plane 20. According to FIG. 2, guide vanes 1, comprising vane blade 2 and vane root 3, are inserted in the casing 21 in circumferential peripheral grooves 10. Arranged respectively between the guide vanes there are intermediate pieces 4. The intermediate pieces 4 can be differentiated as intermediate pieces 4*a* without recesses and intermediate pieces 4*b* with recesses 11. These recesses 11 serve to receive bolts 8. By means of the bolts 8, which are anchored in the casing 21 in blind holes 5, the guide vanes and the intermediate pieces are divided up into aggregates A1–A7. The aggregates A2–A5 are identical in terms of the number of intermediate pieces 4 and guide vanes 1. In terms of the design and arrangement of the intermediate pieces 4, the aggregates A2 and A4 and the aggregates A3 and A5 are identical.

Figure 3:
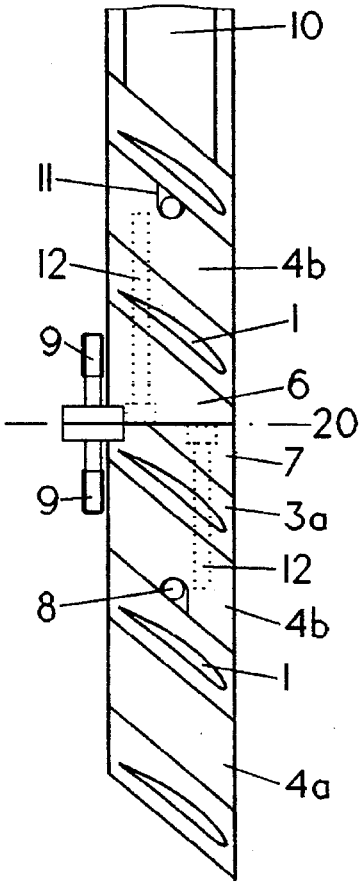
FIG. 3 shows the partial developed view of a row of guide vanes in the region of the detail II from FIG. 1.

According to FIG. 3, the end aggregates A6 and A7 adjoining the partition plane 20 are designed having divided intermediate pieces 6 and 7. In order to be able to fasten these divided intermediate pieces 6 and 7 in the peripheral groove 10, they are connected to the adjoining guide vane 1 and the intermediate piece 4*b* by screws 12 and pins (not represented). The end aggregates A6 and A7 are subsequently machined at the factory such that, in the on-site assembly, further machining steps are no longer necessary. In the case of the end aggregate A7, the vane root 3*a* of the guide vane 1 is also modified in this process. The end aggregates A6 and A7 are fixed in the casing 21 by the head of anchoring screws 9.

In order to install the guide vanes 1 in the casing 21, the casing is opened along the partition plane 20 by means of flanges (not shown). The upper casing half 21*b*is rotated by one hundred and eighty degrees in the axial direction and is arranged alongside the lower casing half 21*a*. Owing to the rotational symmetry of the casing 21, the installation of the aggregates A1–A7 is identical for both casing halves 21*a* and 21*b*. For this reason, only the lower casing half 21*a* will be described below. Firstly, the guide vanes 1 and intermediate pieces 4 of the aggregate A1 are inserted, corresponding to the position in FIG. 1, into the peripheral groove 10. On each side, a bolt 8 is pressed into the pre-drilled blind holes 5. Then, on each side of the aggregate A1, an intermediate piece 4*b* with recess 8 is inserted into the peripheral groove 10, as well as the guide vanes 1 and intermediate pieces 4 belonging to the aggregates A2 and A3. A bolt 8 is again anchored in place in each case and afterwards the aggregates A4 and A5 are inserted into the peripheral groove. There then follows again the anchorage of a bolt 8 in each case in the casing 21*a*. The end aggregates A6 and A7 are inserted as a unit and fixed by the anchoring screws 9 in the lower casing half 21*a*. The end aggregates A6 and A7 are produced with a negative tolerance, so that they do not protrude over the partition plane 20.

The installation of any further rows of guide vanes (not represented) is realized in corresponding fashion, although the number of guide vanes may in this case vary. Once all the guide vanes 1 and intermediate pieces 4 have been installed, the rotor (not represented) is inserted with the guide vanes into the lower casing half 21*a*. The upper casing half 2l*b* is rotated back into its original position and connected to the lower casing half 21*a*.

Of course, the invention is not limited to the exemplary embodiment shown and described. The guide vanes can also be installed without intermediate pieces, in which case recesses for receiving the bolts must then be provided in the vane roots which are dimensioned correspondingly larger. The number of bolts, and hence of guide vane aggregates, is realized according to a desired play distribution and on the basis of the production tolerances. The design of the bolts is optional. The aggregates can also have a different number of guide vanes compared to another.

Obviously, a multiple division of the casing is also possible, in which case the number of end aggregates is increased. The connection of the end aggregate can also be realized by methods other than by screwing and pinning.

Obviously, numerous modifications and variations of the present invention are possible in the light of the above teachings. It is therefore to be understood that within the scope of the appended claims, the invention may be practiced otherwise than as specifically described herein.

LIST OF DESIGNATIONS

1 Guide vane
2 Vane blade
3 Vane root
3*a* Modified vane root
4 Intermediate pieces
4*a* Intermediate piece without recess
4*b* Intermediate piece with recess
5 Blind hole
6 Divided intermediate piece
7 Divided intermediate piece
8 Bolt
9 Anchoring screw
10 Peripheral groove
11 Recess
12 Screw
20 Partition plane
21 Casing
21*a* Lower casing half
21*b* Upper casing half
A1–A5 Aggregates of guide vanes with intermediate pieces
A6, A7 End aggregates

What is claimed as new and desired to be secured by Letters Patent of the United States is:

1. A compressor having an axially divided casing, the compressor comprising:

a plurality of casing halves in which guide vanes are fastened by their roots in peripheral grooves of the casing, wherein aggregates which include a plurality of the guide vanes are bordered on each side by bolts which are substantially evenly arranged over a periphery of the casing, and project substantially radially into the peripheral groove.

2. The compressor as claimed in claim 1, wherein the guide vane roots adjacent to the bolts are provided with recesses for receiving the bolts.

3. The compressor as claimed in claim 1, wherein intermediate pieces are arranged in the peripheral groove between the guide vane roots, the intermediate pieces adjacent to the bolts being provided with recesses for receiving the bolts.

4. The compressor as claimed in claim 3, wherein end aggregates comprise at least one guide vane and a divided intermediate piece, which are joined together as fastening means.

5. The compressor as claimed in claim 4, wherein the end aggregates are fastened in the casing by anchoring screws.

6. A compressor having an axially divided casing, the compressor comprising:

a plurality of casing halves in which guide vanes are fastened by their roots in peripheral grooves of the casing, wherein bolts are positioned in a groove base of the peripheral grooves, said bolts being distributed over a periphery of the casing, and projecting substantially radially into the peripheral groove, said bolts dividing the guide vanes into aggregates and end aggregates which are situated at a partition plane of the casing.

* * * * *